US008191867B2

(12) United States Patent
Spiegel

(10) Patent No.: US 8,191,867 B2
(45) Date of Patent: Jun. 5, 2012

(54) METHOD AND APPARATUS FOR CARBONIZING A LIQUID

(75) Inventor: Pasquale Spiegel, Glinde (DE)

(73) Assignee: Margret Spiegel, Glinde (DE)

( * ) Notice: Subject to any disclaimer, the term of this patent is extended or adjusted under 35 U.S.C. 154(b) by 0 days.

(21) Appl. No.: 12/904,406

(22) Filed: Oct. 14, 2010

(65) Prior Publication Data

US 2011/0081468 A1 Apr. 7, 2011

Related U.S. Application Data

(63) Continuation of application No. 12/478,390, filed on Jun. 4, 2009, now abandoned, which is a continuation of application No. 12/039,217, filed on Feb. 28, 2008, now abandoned, which is a continuation of application No. 11/671,186, filed on Feb. 5, 2007, now abandoned, which is a continuation of application No. PCT/DE2005/001348, filed on Jul. 29, 2005.

(51) Int. Cl.
*B01F 3/04* (2006.01)

(52) U.S. Cl. ..... 261/29; 261/36.1; 261/DIG. 7

(58) Field of Classification Search ..... 261/24, 261/28, 29, 36.1, 53, 54, 63, 64.1, 66, 83, 261/84, DIG. 7
See application file for complete search history.

(56) References Cited

U.S. PATENT DOCUMENTS

| | | | | |
|---|---|---|---|---|
| 3,731,845 | A * | 5/1973 | Booth | 222/67 |
| 3,846,515 | A | 11/1974 | Williamson | |
| 3,960,066 | A | 6/1976 | LaRocco et al. | |
| 4,193,745 | A | 3/1980 | Hamilton et al. | |
| 4,216,879 | A | 8/1980 | McMilin | |
| 4,601,645 | A | 7/1986 | Schmitkons | |
| 5,413,742 | A * | 5/1995 | Gatter | 261/140.1 |
| 5,417,146 | A | 5/1995 | Zimmer et al. | |
| 5,842,600 | A * | 12/1998 | Singleterry et al. | 222/1 |
| 6,182,949 | B1 | 2/2001 | Mobbs | |
| 6,607,360 | B2 | 8/2003 | Fong | |
| 6,725,687 | B2 | 4/2004 | McCann et al. | |
| 7,077,293 | B2 | 7/2006 | McCann et al. | |
| 7,080,525 | B2 * | 7/2006 | McCann et al. | 62/389 |
| 7,597,124 | B2 | 10/2009 | Litto | |
| 2006/0288874 | A1 | 12/2006 | Ziesel | |

FOREIGN PATENT DOCUMENTS

| | | | |
|---|---|---|---|
| DE | 22 03 744 | A1 | 9/1972 |
| DE | 42 28 777 | A1 | 3/1994 |
| FR | 2 794 454 | A | 12/2000 |
| GB | 674 285 | A | 6/1952 |
| WO | WO 2005/009598 | | 2/2005 |

* cited by examiner

*Primary Examiner* — Charles Bushey
(74) *Attorney, Agent, or Firm* — Henry M. Feiereisen; Ursula B. Day

(57) ABSTRACT

A system and method for carbonizing a liquid, such as tap water with $CO_2$, are disclosed. The liquid is carbonized inside a pump housing, thereby obviating the need for a separate high-pressure carbonator tank and a separate feed pump. The pump housing has an inlet for receiving in combination the liquid and $CO_2$ at a first pressure, and an outlet for transporting the liquid carbonized with $CO_2$ from the pump housing into an outlet line at a second pressure higher than the first pressure. A constriction is disposed in the outlet line for producing said higher pressure with the pump. The system and method can be employed in closed-loop carbonizing systems in the beverage industry.

12 Claims, 9 Drawing Sheets

METHOD AND APPARATUS FOR CARBONIZING A LIQUID

CROSS-REFERENCES TO RELATED APPLICATIONS

This application is a continuation of prior filed U.S. application Ser. No. 12/478,390, filed Jun. 4, 2009, abandoned, which in turn is a continuation of prior filed U.S. application Ser. No. 12/039,217, filed Feb. 28, 2008, abandoned, which in turn is a continuation of prior filed U.S. application Ser. No. 11/671,186, filed Feb. 5, 2007, abandoned, which in turn is a continuation of prior filed PCT International application no. PCT/DE2005/001348, filed Jul. 29, 2005, which designated the United States and has been published but not in English as International Publication No. WO 2006/012874 and on which priority is claimed under 35 U.S.C. §120, and which claims the priority of German Patent Application, Serial No. 10 2004 038 563.7, filed Aug. 5, 2004, pursuant to 35 U.S.C. 119(a)-(d). The contents of U.S. application Ser. Nos. 12/478,390, 12/039,217, 11/671,186, PCT International application no. PCT/DE2005/001348, and German Patent Application, Serial No. 10 2004 038 563.7 are incorporated herein by reference in their entirety as if fully set forth herein.

BACKGROUND OF THE INVENTION

The present invention is directed to carbonizing a liquid, such as tap water, with $CO_2$.

Nothing in the following discussion of the state of the art is to be construed as an admission of prior art.

Carbonization can be achieved through addition of $CO_2$ to a liquid, such as tap water. The tap water pressure is increased by using at least one pump which increases the liquid pressure and the pressurized liquid is then pressed at a high-pressure into a so-called carbonator tank or vessel. However, both the pressure of the liquid and the pressure increase inside the carbonator tank increase. Such type of carbonization is primarily used in the dispensing equipment industry, for beverage dispensing fountains and post-mix systems.

This type of carbonization with a carbonator tank is employed, for example, in above-counter systems with integrated cooling for tap water and syrup, in below-counter systems with cooling for tap water and syrups, as well as in closed-loop carbonator systems.

The so-called closed-loop carbonators are also employed in conjunction with a device referred to by the technical term python. The python is used for connecting, for example, syrup lines and gas lines as well as a still (supply) water line and also a carbonizing line. These lines are bundled and thermally insulated from the carbonator to the fountain. In this type of application, tap water and $CO_2$ is carbonized by using a pressurizing pump inside a carbonator tank, wherein the carbonized water is then fed to a closed-loop system. In a closed-loop system, the carbonized water is always kept in motion in the direction of the fountains with the assistance of a closed-loop pump, and always runs through a cooler for the liquids for maintaining the carbonized water at an ideal dispensing temperature for producing post-mix beverages. These systems utilize two pumps, one pressurizing pump for carbonizing and a closed-loop pump for keeping the carbonizing water in circulation. One of these pumps can also operate a closed-loop still water circulation, i.e., for circulating tap water in a closed-loop that is not enriched during circulation. The closed-loop still water circulation is primarily used for cooling syrup or for mixing carbonized water with still water or for maintaining a closed-loop circulation for carbonized liquids.

The used pumps in the afore-described systems are mainly displacement pumps, such as those sold by the company Maprotec, which are made of a brass housing or a VA steel housing. This type of pumps is predominantly used as pressurizing pump for water in order to fill, for example, a carbonator tank with water in the feed region. One of the pumps is frequently mounted on the tank, which produces a backpressure to the pump. This backpressure causes the pump to maintain the pressure, because the pump cannot displace the supplied water quantity, by producing a pressure increase inside the pump housing, because water cannot be compressed; the space between static component and mechanical parts of the pump in the interior experiences a pressure increase, so that the pump can displace the supplied water quantity for, for example, filling one or more carbonator tanks.

The injected water is simultaneously added together with—preferably—$CO_2$ during water injection, and at least one fountain is provided with the carbonized liquids, whereby the carbonized liquid can be withdrawn or at least a post-mixed drink can be produced. The carbonized liquid contained in the carbonator tank is also used to supply a python with carbonized liquid. This application is mainly used for the post-mix operation, involving fountains which have at least one inlet for carbonized liquids and at least one inlet for beverage syrups. The two liquids are mixed during the pouring process, thus producing a preferably carbon dioxide-containing refreshment beverage. The high pressure that exists in the carbonator, which is in turn produced by the pressure increase of the pump, is used to feed the python or to operate fountains with the predetermined pressure of the carbonator. This high pressure is also needed to open, for example, three fountains simultaneously. This could not be attained, for example, with the 3 bar main water supply. The same principle applies also to the closed-loop carbonator system.

It would therefore be desirable and advantageous to provide an improved device and method for carbonizing a liquid, which obviates prior art shortcomings and is able to specifically perform carbonization inside one pump housing or several pump housings during operation of the pump.

SUMMARY OF THE INVENTION

The invention takes advantage of the fact that at least one pump implements carbonizing inside the pump, by supplying at the inlet side of the pump for liquids preferably $CO_2$ and tap water. This is mostly received by the pump through self-priming. Accordingly, $CO_2$ with water is now inside the pump housing, causing the pump to build up the required pressure necessary for this type of carbonization. The line has at least one cross-sectional constriction at the outlet for the fluids and fluid lines at the pump. This liquid is according to the applied principle mixed with preferably $CO_2$ which exits the pump at high pressure in carbonized form. The high pressure is produced inside the pump housing when the cross-sectional constriction is located before the pump outlet, because the pump must displace the supplied liquid which is preferably mixed with $CO_2$. During this displacement, the preferred carbonization takes place simultaneously, for example in the carbonator tank. Carbonization inside at least one pump housing has the advantage that carbonization is performed in a continuous flow process, for example by using an inline carbonator. With the present invention, the aforementioned carbonizing systems can advantageously be completely eliminated, because the required pump in pump carbonator systems is used so as to simultaneously carbonize, rather than only pumping liquids and increasing their pressure.

According to one aspect of the invention, a system for carbonizing a liquid with $CO_2$ includes a pump with a pump housing defining an interior for receiving a liquid and $CO_2$ for carbonizing the liquid.

According to another feature of the present invention, the pump housing may include at least one inlet for receiving in combination the liquid and $CO_2$ at a first pressure, and at least one outlet for transporting the liquid carbonized with $CO_2$ from the pump housing into an outlet line at a second pressure higher than the first pressure.

According to another feature of the present invention, at least one cooling system may be connected to the outlet line, wherein the liquid carbonized with $CO_2$ flows through the cooling system to at least one dispensing fountain According to another feature of the present invention, a constriction may be disposed in the outlet line for generating the second pressure.

According to another aspect of the invention, a closed-loop system for carbonizing a liquid with $CO_2$ includes a pump having a pump housing, wherein the pump housing has at least one inlet for receiving—in combination—the liquid and $CO_2$ at a first pressure, at least one outlet for transporting the liquid carbonized with $CO_2$ from the pump housing into an outlet line at a second higher pressure, a constriction disposed in the outlet line for generating said higher pressure, a chiller disposed downstream of the constriction, a dispensing fountain with taps disposed downstream of the chiller, and an overflow line connecting the fountain and the pump housing for returning to the pump liquid carbonized with $CO_2$ that is not drawn off at the fountain.

In a corresponding method for carbonizing a liquid with $CO_2$ according to the invention, the liquid and $CO_2$—in combination—are received at least one inlet of a pump at a first pressure, the liquid and $CO_2$ are carbonized inside the pump at a second pressure higher than the first pressure, and the liquid carbonized with $CO_2$ is transported through a pump outlet into an outlet line, wherein the higher pressure is produced as a result of a constriction disposed in the outlet line.

Embodiments of the invention may include one or more of the following features. The pump may be an electrically driven pump or a displacement pump, which may be driven by a gas, wherein carbonizing takes place inside a pump housing by increasing a displacement pressure inside the pump housing. The system may also include a mixing unit or pre-mixer disposed upstream of the at least one inlet for combining the liquid with $CO_2$, and further at least one pressure regulator for the liquid and at least one pressure regulator for $CO_2$. At least one overflow valve with pressure adjusting capability may be installed on the pump housing. Alternatively or in addition, at least one bypass or overflow valve disposed inside or outside the pump. At least one hollow container filled with a solid material may be disposed in the at least one inlet, allowing the pump to be operated in a pulsed mode. The constriction may be integrally formed with the pump or may be in the form of a separate insert disposed in the inlet and/or outlet line of the pump. At least one connection may be provided for admitting a cleanser for cleaning the pump or components of the system.

The closed-loop system may include a pressure regulator for regulating an inlet pressure of the liquid, such as tap water, and a pre-chiller for cooling the pressure-regulated liquid.

The present invention provides an even greater advantage with respect to savings in material and energy for closed-loop carbonators, because conventional closed-loop carbonators require at least two pumps for the closed-loop operation, namely a first pressurizing pump to fill the carbonator tank and to perform carbonizing, and at least one second closed-loop pump to maintain circulation of the liquid in the closed-loop system. With the invention, the pressurizing pump and the entire carbonator system can therefore be eliminated. Only required is the closed-loop pump having, for example, a VA steel pump housing, which is used simultaneously for carbonizing as well as for maintaining a closed-loop circulation of preferably carbonized liquids. The cross-sectional constriction of the line in which the preferred carbonized liquid is kept in circulation, is preferably installed on the pump outlet side, because only the pressure produced by the water supply for the pump is present downstream of the cross-sectional constriction. This is used in the system of the invention to supply the pump with liquids and gases to, for example, replenish liquid withdrawn when beverages are dispensed. The low pressure at the pump inlet and the cross-sectional constriction at the pump outlet is also used to allow liquids and gases to enter the pump at a normal building water pressure, which can then enter the closed-loop circulation and the higher pressure inside the pump housing. In this way, the quantity of carbonized liquid withdrawn at the fountain is replenished at the same time with an identical quantity of fresh liquid. This also guarantees that the pump cannot run dry, potentially damaging the pump.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
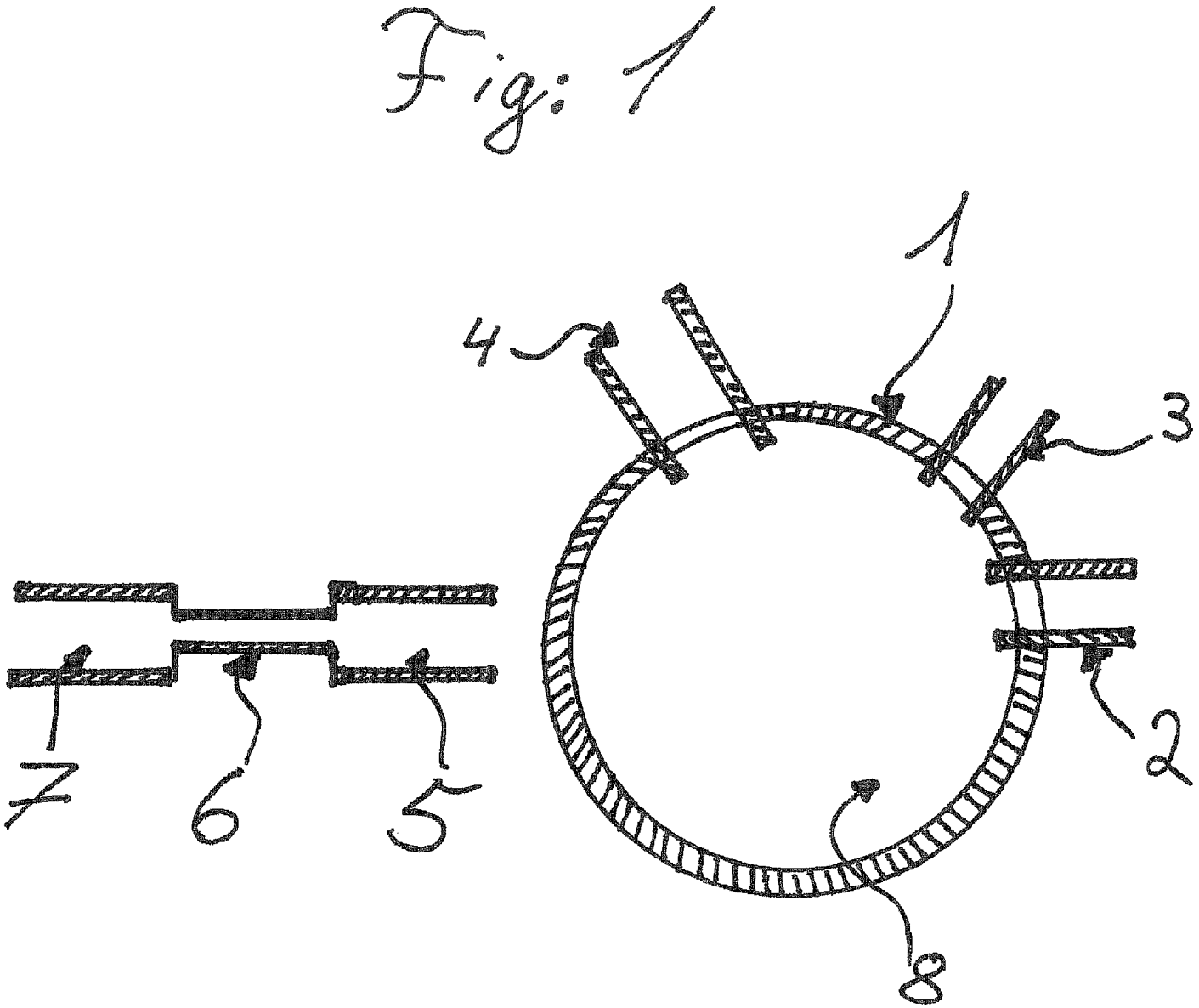
FIG. 1 shows a schematic illustration of a pump and an inlet and/or outlet line having a constriction.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a pump 1, preferably with a VA steel pump housing, which may be operated by at least one electric motor (not shown). The pump 1 has a pump housing 8 with an interior chamber and a connection 4 (e.g., an inlet) for connection to at least one main liquid supply, for example tap water, as well as at least one gas supply, preferably $CO_2$. The liquid and the gas can enter the interior of the pump housing 8 via the fitting 4. Movable parts (e.g., pump rotor or diaphragm; not shown) inside the pump housing 8 driven by, for example, the electric motor (not shown) can transport the liquid with the dissolved gas, such as $CO_2$, under overpressure to a connection 3, e.g. the pump outlet, into a line 5. The line 5 can have a cross-sectional constriction 6 to increase the pressure in the pump housing 8 for initiating the desired carbonization. Carbonized liquid can then be withdrawn at a dispensing fountain (see FIGS. 8 and 9) connected to line 7.

A connection 2 for an overflow valve or a relief valve may be provided on the pump 1 to allow additional adjustment of flow through a bypass or, preferably, of the pressure in the pump 1.

FIGS. 2 through 7 depict additional embodiments of the pump 1 and pump housing 8. The pumps illustrated in FIGS. 1 through 7 are preferably employed with a closed-loop carbonizing system of the type depicted in FIGS. 8 and 9.

Figure 2:
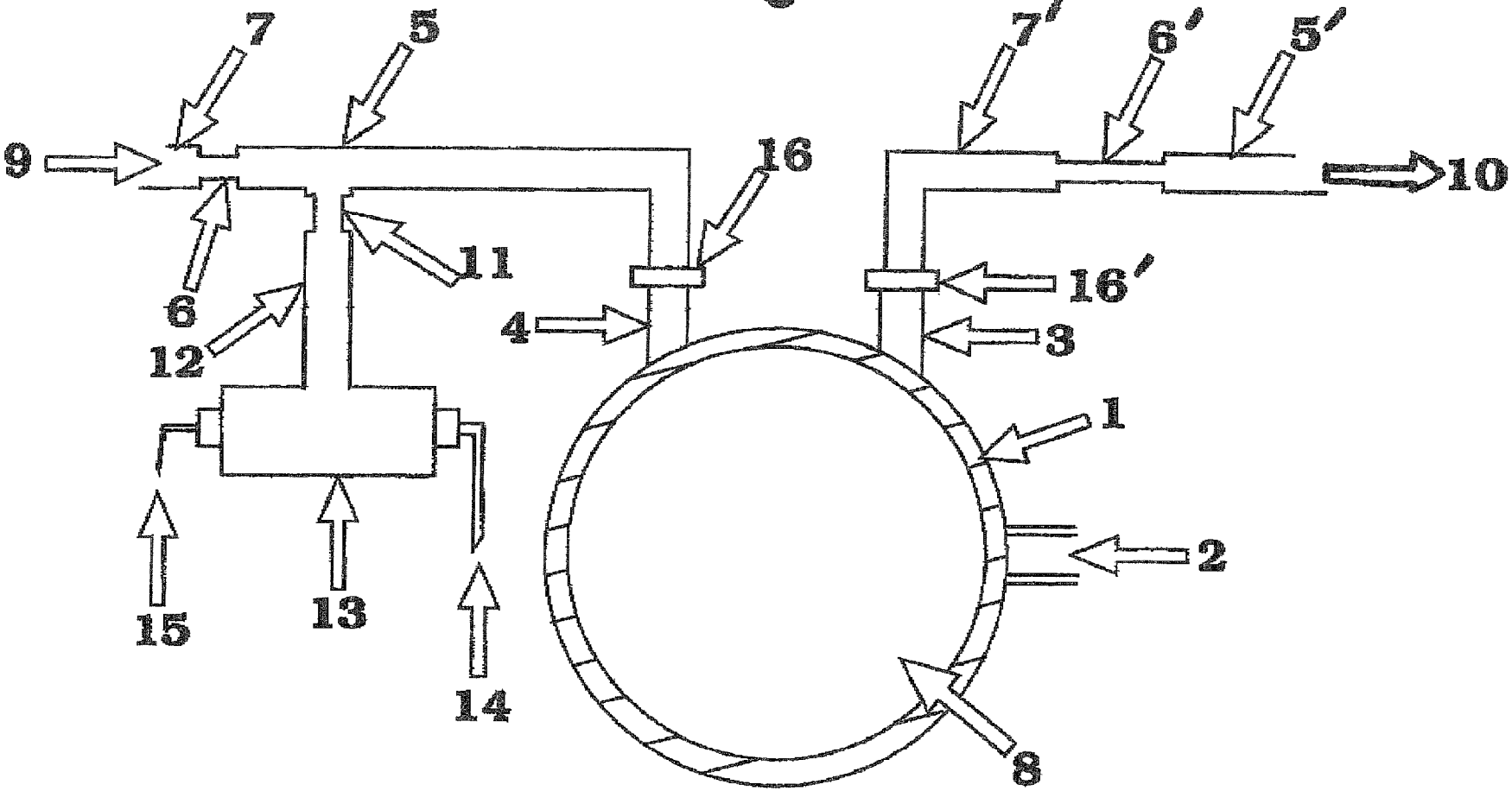
FIG. 2 shows a schematic illustration of the pump of FIG. 1 with an inlet connected to a liquid and gas supply and an outlet for carbonized liquid.

FIG. 2 shows schematically a housing 1 which is preferably manufactured of VA steel, with at least one inlet 4, preferably for allowing tap water and $CO_2$ to flow into the housing 8 or to be drawn into the housing 8 of the pump 1 by suction.

The line 5 which may be in the form of a T-piece 5 is attached by a fitting or flange 16. A cross-sectional constriction 6 is attached to the T-piece 5. The constriction 6 is sized to limit the flow of carbonized liquid through line 7 in the direction indicated by arrow 9 in closed-loop carbonators when pouring beverages from, for example, the post-mix valves 34 (FIGS. 8 and 9), while guaranteeing an adequate volume flow at the valves 34.

The optional connection 11, which may also be implemented as a constriction, on the T-piece 5 enables connection of an inline carbonator (pre-mixer) 12 which receives liquid, such as tap water, and gas, such as $CO_2$, from a feed unit 13 connected to a feed 14 for the liquid and a feed line 15 for the gas.

Figure 7:
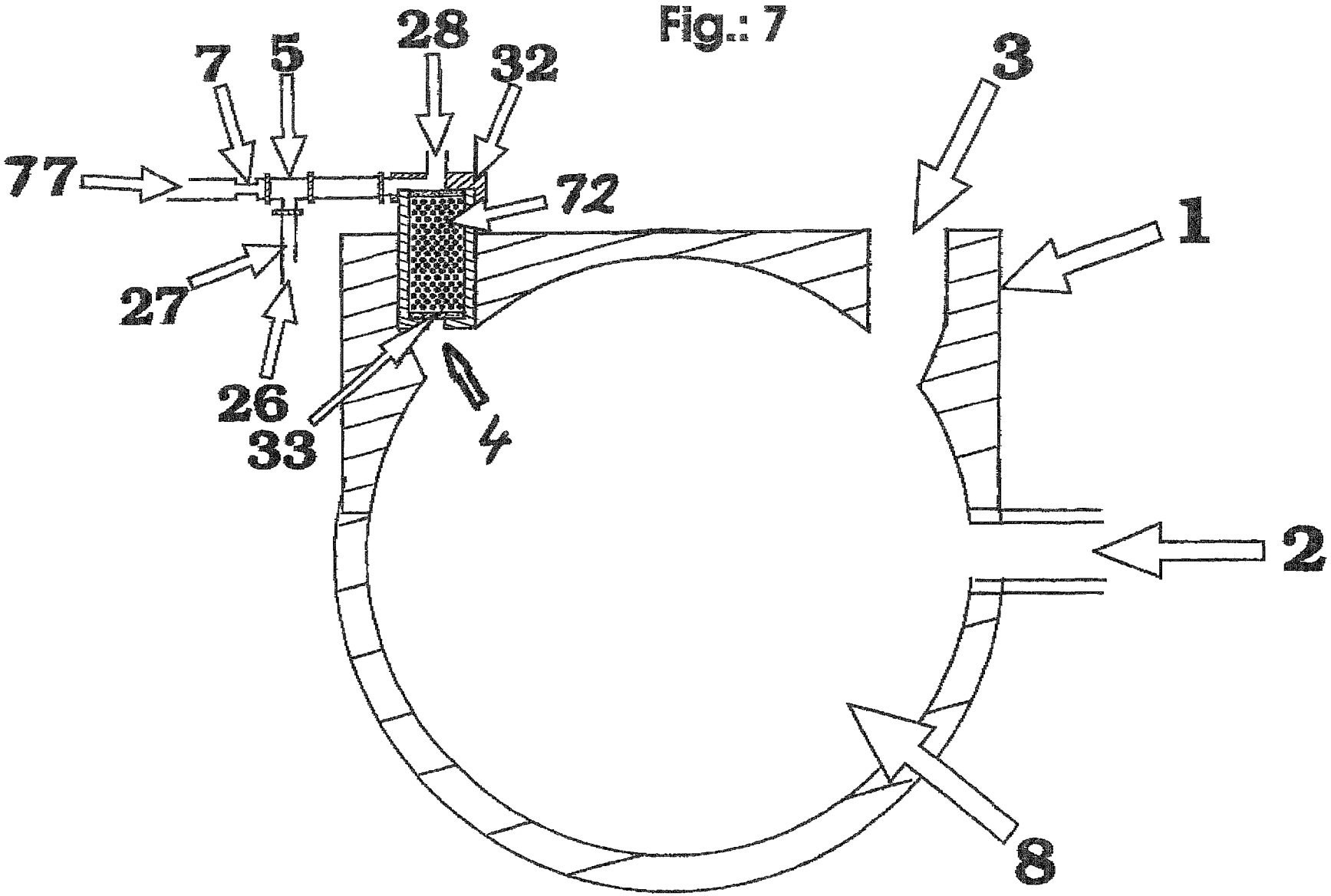
FIG. 7 shows a schematic illustration of a pump housing with a filter installed at the inlet port.

The pre-mixer 12 may be filled with bulk material, as illustrated in FIG. 7. The pump 1 builds up a high pressure inside the pump housing 8 as a result of the cross-sectional constriction 6' implemented downstream of line 7' connected via fitting 16' on the pump outlet side 3. Carbonized refreshment beverages can then flow via the lines 7' and 5' in the direction of arrow 10 to the post-mix valves 34 (see FIGS. 8 and 9).

The role of the outlet 3 and inlet 4 can also be reversed, i.e., pump connection 3 may be used as inlet for the liquid and gas, and the pump connection 4 as outlet for the carbonized liquid.

Figure 3:
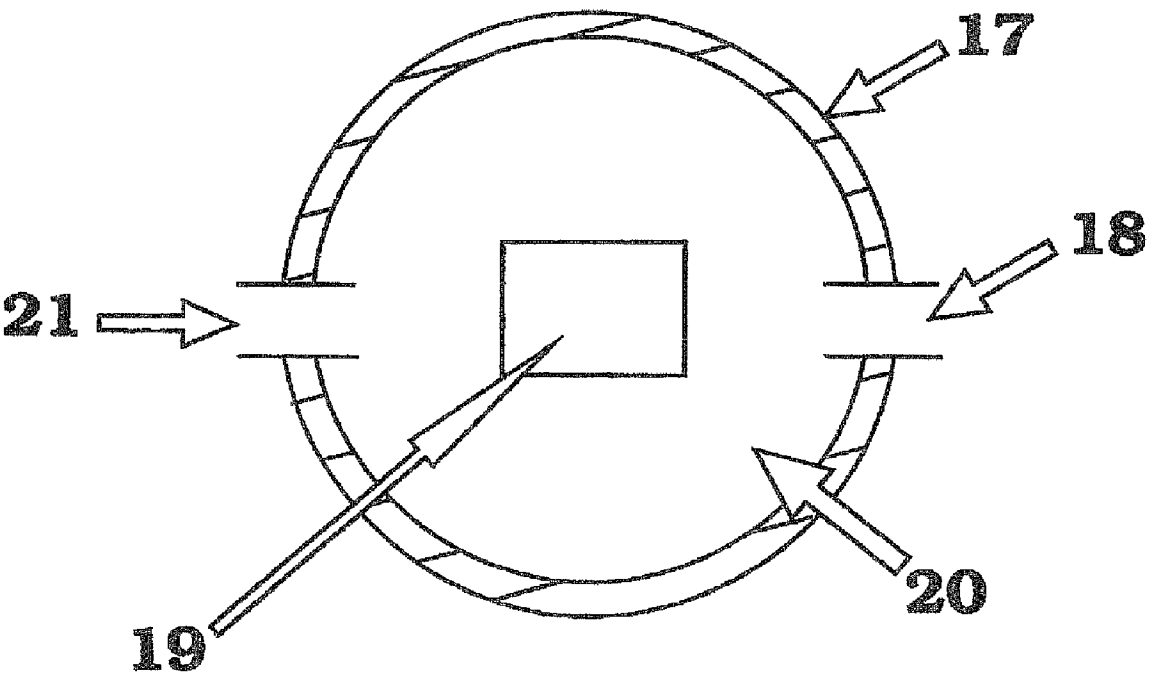
FIG. 3 shows a schematic illustration of a diaphragm pump.

FIG. 3 shows schematically a membrane pump 17 which may be operated electrically or by gas pressure. In this embodiment, the pump housing may be made of plastic. The pump 17 has at least one inlet and outlet 21 for liquids and gases and at least one outlet 18 for carbonized liquid, and at least one chamber 20 used for carbonization. Bypass throughput and/or pressure may be adjusted by a valve indicated schematically with the reference symbol 19.

Figure 4:
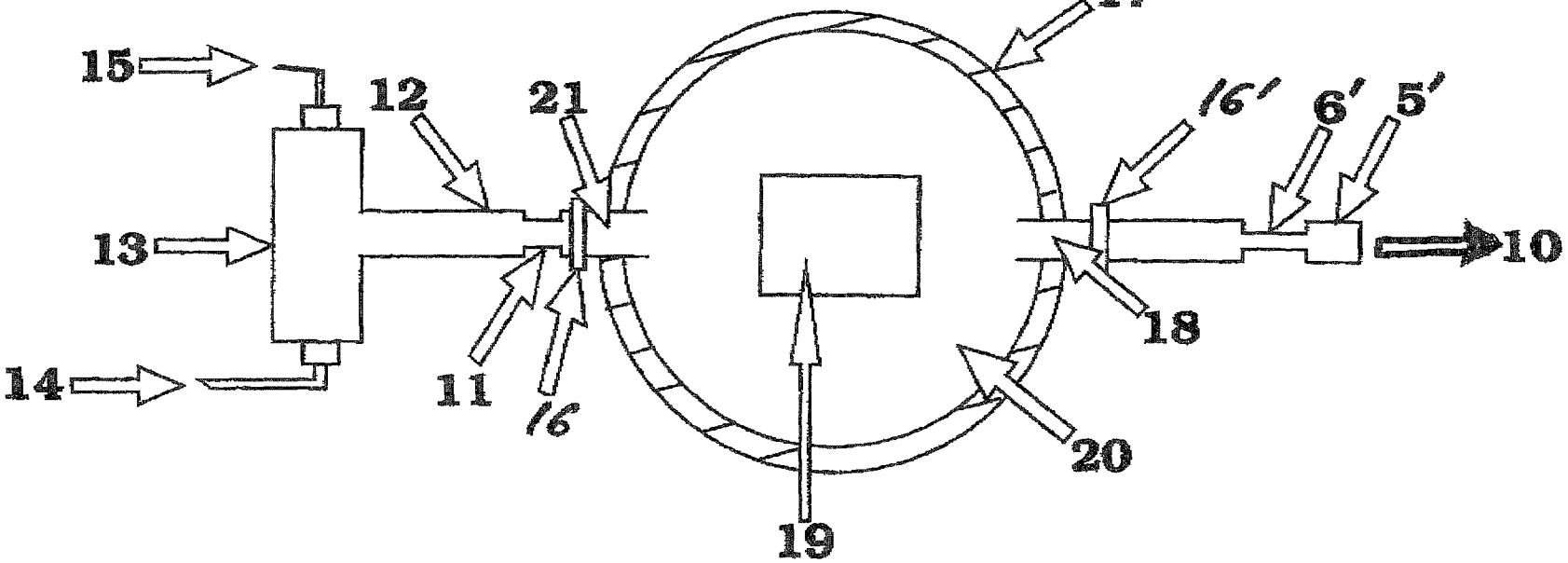
FIG. 4 shows a schematic illustration of the pump of FIG. 3 with an inlet connected to a liquid and gas supply and an outlet for carbonized liquid.

FIG. 4 is a schematic illustration of the pump 17 connected with inlet and outlet lines similar to those depicted in FIG. 2. Although the exemplary line 5 in FIG. 4 does not have the T-piece, it will be understood that such T-piece may be included. In all other aspects, the connections and the operation of pump 17 is identical or at least similar to that of pump 1 of FIG. 2.

Figure 5:
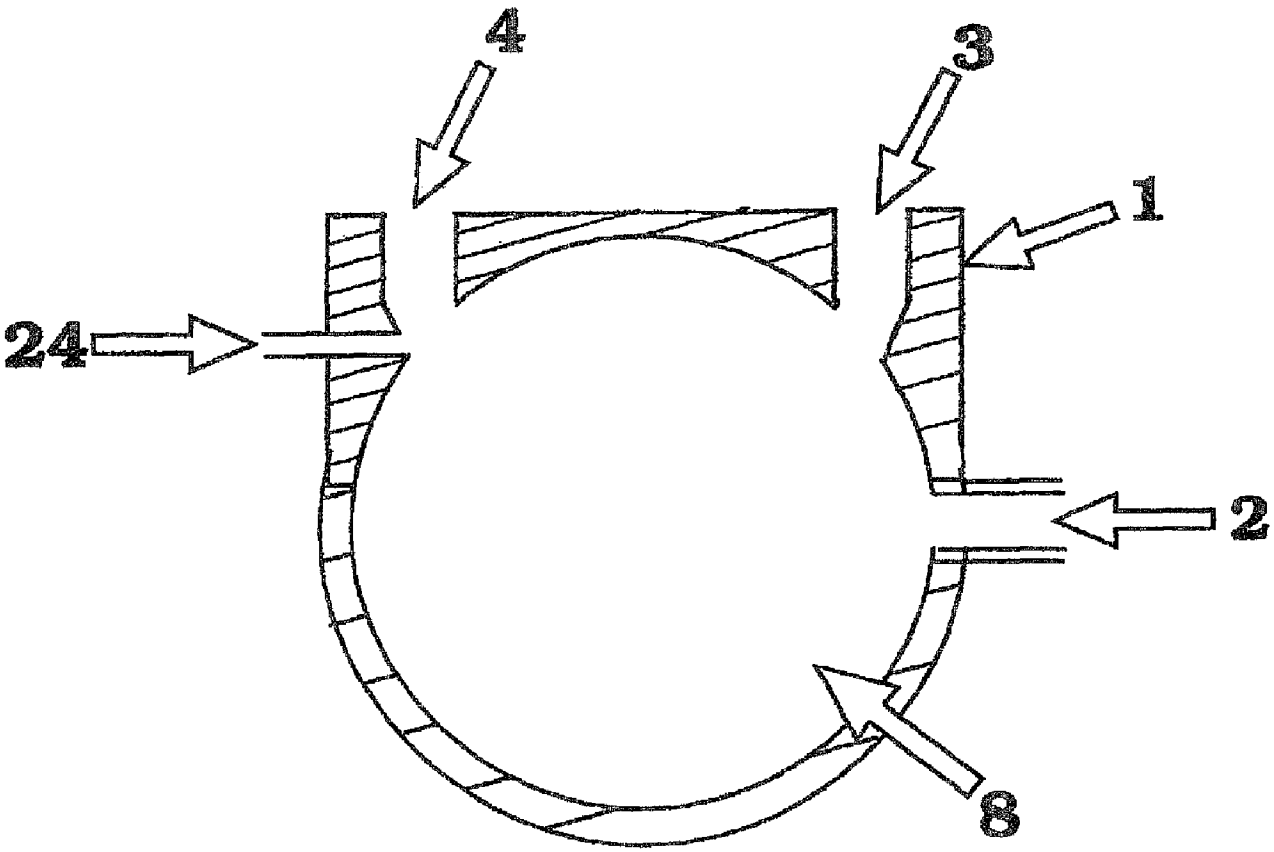
FIG. 5 shows a schematic illustration of a pump housing with an additional inlet port.

FIG. 5 shows schematically the pump housing 1 of FIG. 1 with an additional feed 24 disposed on or inside the pump 1, in addition to the inlet 4 and outlet 3 so that gases or liquids can be transported separately or together towards the pump interior 8, for example, by using also the optional bypass 2.

Figure 6:
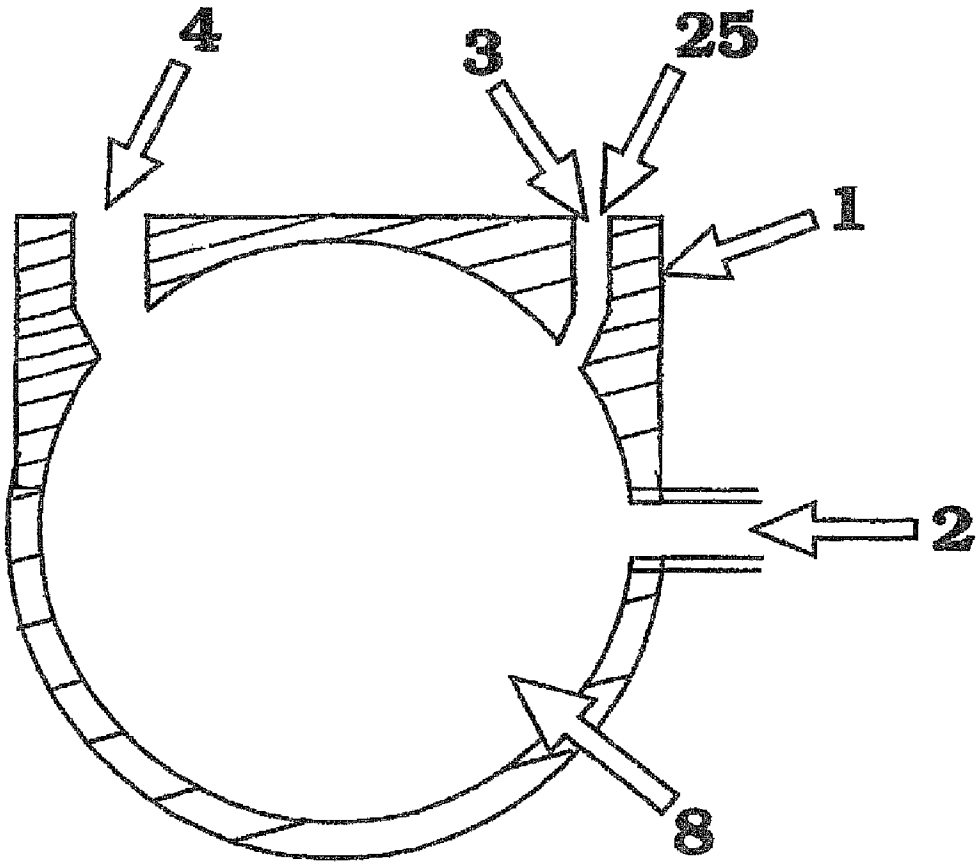
FIG. 6 shows a schematic illustration of a pump housing with a built-in constriction at the outlet port and a separate insert forming a constriction.
Figure 6:
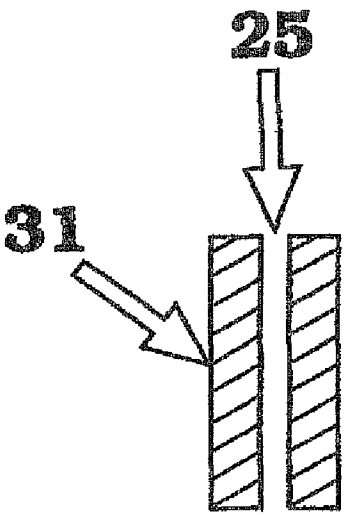

FIG. 6 shows schematically the pump housing 1 of FIG. 5 (the additional feed 24 has been omitted for sake of clarity) which is herein provided with a built-in (e.g., implemented at the factory) cross-sectional constriction 25 on the pump outlet 3 to provide the high-pressure required for carbonization at the outlet 3. The constriction 25 can also be implemented in a regularly sized pump outlet by retrofitting the pump outlet 3 with an insert 31, as indicated in FIG. 6 by the inset (A).

Figure 8:
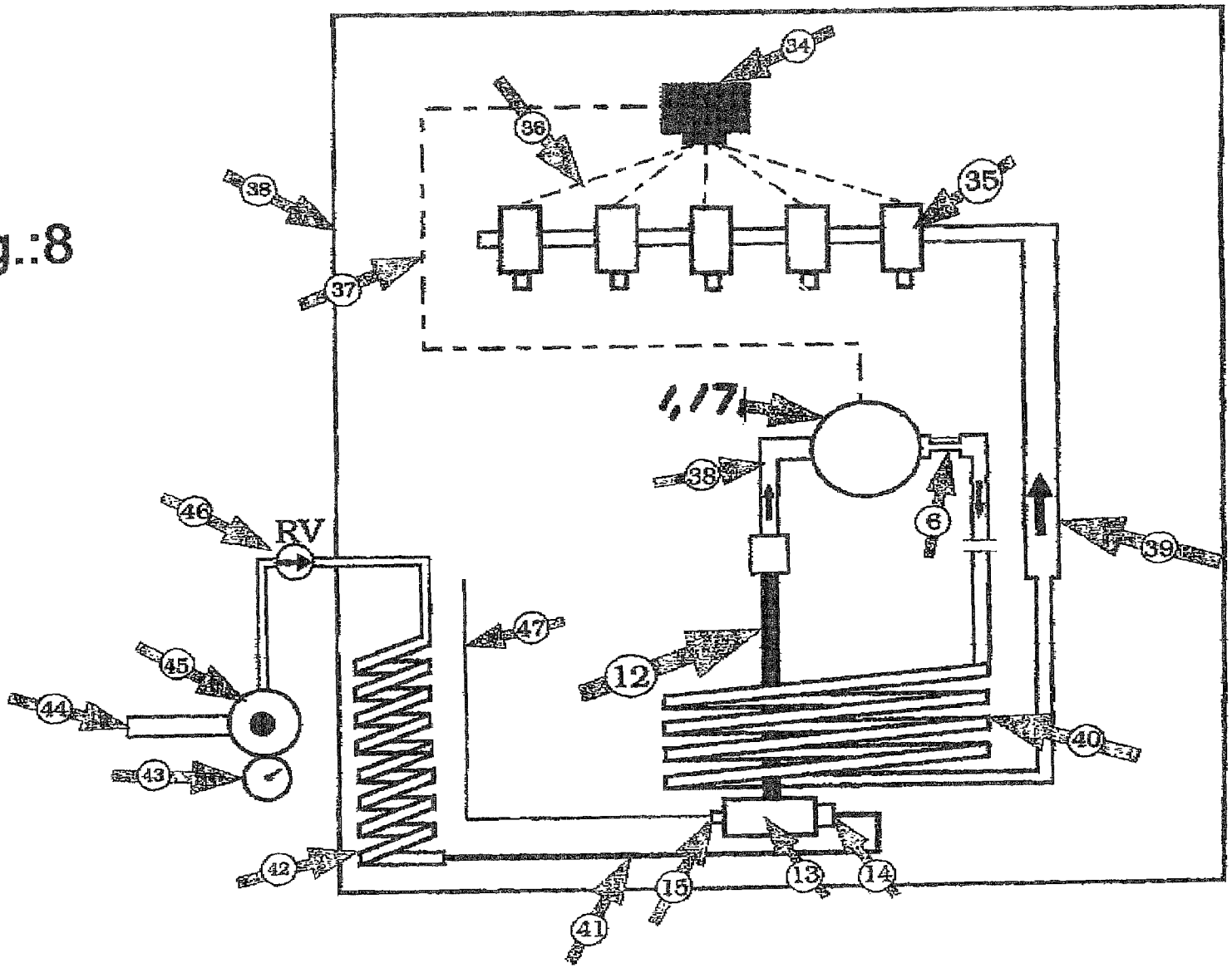
FIG. 8 shows a schematic illustration a beverage dispensing system with an above-counter post-mix fountain with an integrated carbonator system and continuous flow cooling.
Figure 9:
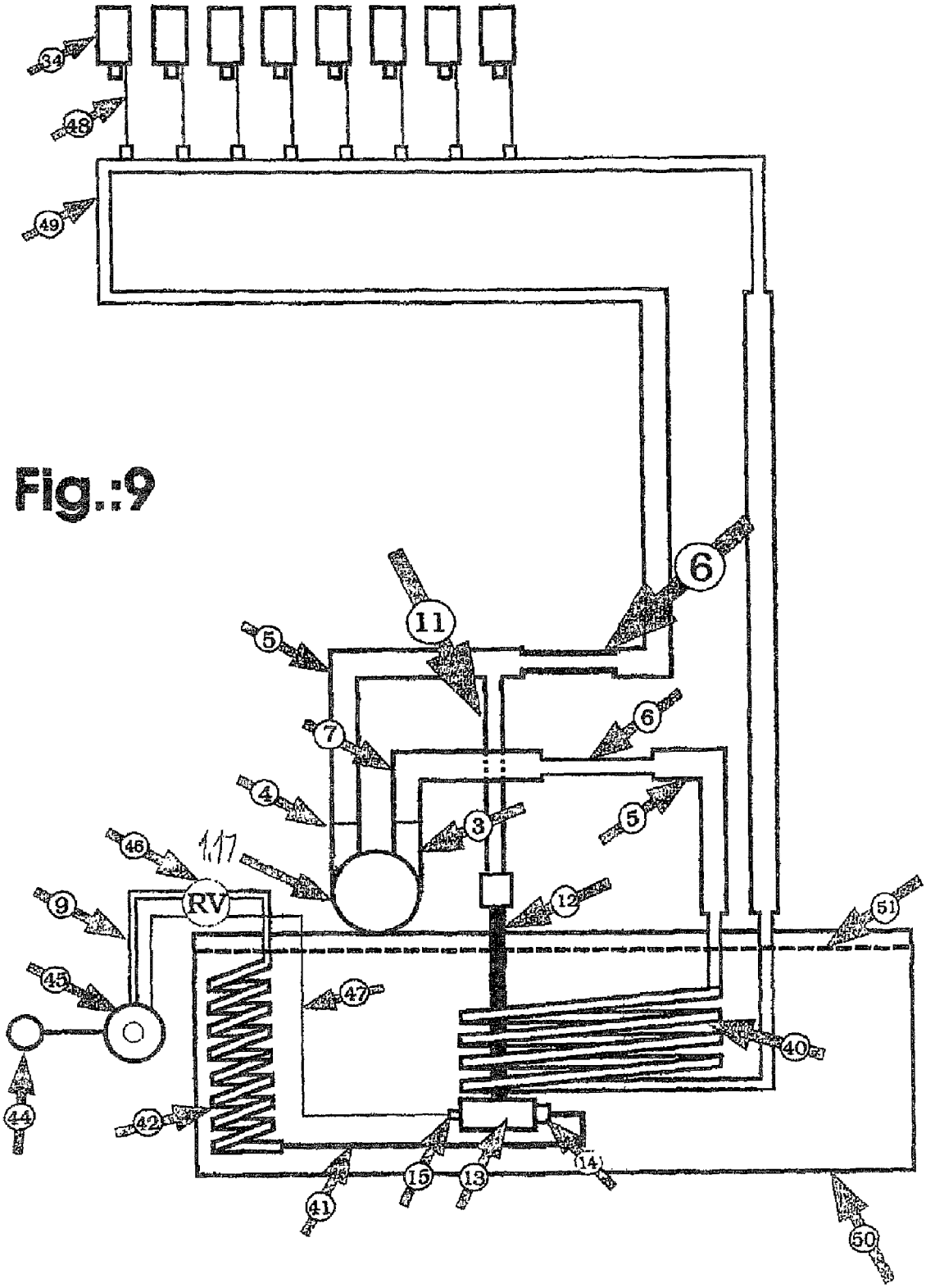
FIG. 9 shows a schematic illustration of another embodiment of a closed-loop carbonator with post-mix valve feed.

FIG. 7 shows schematically the pump housing 1 of FIG. 5 (the additional feed 24 has been omitted for sake of clarity) wherein at least one inline pre-mixer 72 is installed on the pump inlet side 4 which has an opening 28 for admission of gases, for example $CO_2$, and an opening 26 for admission of liquid, preferably tap water, from line 27. With this configuration, the pump 1 can be used as impulse carbonator pump 1, which carbonizes inside the pump housing 8, and simultaneously also as a closed-loop pump 1 if no beverage is dispended at the fountain 34 (FIGS. 8 and 9). For example, $CO_2$ is admitted to the inline pre-mixer 72 through the opening 28 only during the pouring operation.

The inline pre-mixer 72 may include a bulk material 33, preferably in the form of fine particles, secured in a hollow holder retaining the material 33. The hollow holder has at least two openings to allow inflow and outflow of un-carbonized or carbonized liquid. A cleaning fluid may be introduced through line 77.

FIG. 8 shows schematically a beverage dispensing system 38 with an above-counter post-mix fountain with an integrated carbonator system operating with continuous flow cooling with still water pre-cooling 42 and post-cooling. The dispensing system 38 is adapted to employ any of the pump configurations depicted in FIGS. 1 through 7.

In this process, carbonization can take place via the pump 1, 17 in a continuous flow process. The carbonized water remains in the line 37, 39 until it is poured. If necessary, for example when the beverage is dispensed, liquid such as tap water, and $CO_2$ can be added via line 38 only during the pouring process and carbonized in the pumps 1, 17. This eliminates any deficit of carbonized liquid, for example, interruption in the supply of carbonized liquid in the lines 37, 39, and/or at the post-mix taps 34. Only the pressure set by the main liquid supply supplied through pre-chiller 42 is present between the cross-sectional constriction 6 and line 39. Otherwise, at least one additional pressurizing pump needs to be added to increase the main water pressure before the feed to the pump 1, 17. Upstream of the liquid feed to the pump 1, 17, means are provided for cleaning the pump 1, 17 and all lines and fountains and for introducing the cleaning material, as mentioned in the discussion of FIG. 7. The pump 1, 17 has at least one bypass and pressure adjusting capability, as well as at least one overflow valve located inside or outside the pump 1, 17 or the pump housing 8, 20 (See, for example, FIGS. 3 and 6).

Metered, preferably filtered, tap water is supplied via the line 44 to a preferable automatic pressure regulator 45 having a gauge 43. The tap water then flows through a check valve or backflow preventer 46 through the pre-chiller 42 and line 41 to inlet 14 of pre-mixer 12. The other inlet 15 of pre-mixer 12 is connected to $CO_2$ pressure. The flow pressure is adjusted inside the automatic pressure regulator, for example, via a piston control (not shown), wherein a pressure differential relative to the liquid flow pressure in lines 37, 39, so as to prevent $CO_2$ overpressure relative to the liquid pressure.

The principle of the mutual interdependence is also used to prevent pressure fluctuations in the main water supply so as to maintain a constant dosage of liquid flow and liquid pressure with respect to the $CO_2$ flow and pressure required for carbonizing and main carbonizing of the pumps 1, 17. Otherwise, carbonization may no longer be possible when the liquid pressure increases while the $CO_2$ pressure remains constant, because an increase in liquid pressure prevents $CO_2$ from flowing in the direction of the inline pre-carbonator 12 and the pumps 1, 17, since the $CO_2$ pressure is fixed at a lower pressure. This could be remedied by using a separate $CO_2$ pressure regulator and a separate liquid pressure regulator, for example, the automatic pressure regulator 45.

This approach would also be advantageous when the liquid pressure falls below the $CO_2$ pressure, this the efficiency of the carbonization would decrease in this case, because the gas displaces the liquid, potentially damaging the pumps 1, 17.

Only when liquid is poured from the taps 35 can tap water together with pre-regulated, preferably $CO_2$ flow into the inline pre-carbonator 12 or inline pre-mixer 12 and enter the pump 1, 17 and the pump housing or chamber 8, 20 via the line 38. The cross-sectional constriction 6 causes a pressure increase in the pump 1, 17 to thereby enhances carbonization in the pump housing, in particular in a continuous flow process. For example, membrane pumps operating according to the displacement principle have a smaller space towards the outlet side 3 or 18 which forms a resistance for fluid transport and automatically increases the pump pressure. The pressure decreases again downstream of the cross-sectional constriction 6, potentially reaching the input pressure upstream of the pump inlet 4, 21, which may be equal to the $CO_2$ pressure. After the carbonized liquid has passed through the cross-sectional constriction 6, the carbonized liquid enters the post-chiller 40 and flows through line 39 to the fountain taps 35. Unused carbonized liquid is recirculated from fountain taps 35 through lines 36 to fountain head 34, from where it is returned to the pump 1, 17, for example, supplied to inlet 24 (FIG. 5) of pump 1, 17.

FIG. 9 illustrates schematically a closed-loop carbonator system, for example, for post-mix tap feed of fountain head 34 with carbonized liquids. Preferably, city water can flow through at least one tap water line 44 into the automatic pressure regulator 45' for liquids and gases. Simultaneously, preferably $CO_2$ stored in a reservoir vessel (not shown) can flow into and out of the automatic pressure regulator 45. Like in FIG. 8, both the liquid and the gas flow simultaneously via the lines 41 and 47, respectively, into the feed element 13 for the inline pre-mixer 12, from where the premixed substances are drawn into the pump 1, 17 aided by the pressure differential. The pressure is then significantly increased in the pump 1, and the premixed media can flow through the post-chiller 40 to the fountain head 34 and associated taps. The carbonized liquid circulates in a closed-loop 49, as before, and only the amount of liquid withdrawn when the beverage is dispensed is replenished, so as to maintain the pouring/dispensing operation.

If no liquid is poured, then the pump 1 is used only for recirculating the liquid and for re-cooling the carbonized liquid in the post-chiller 40. Feed lines 48 branch off from the closed-loop 49 to supply the fountain head 34 and taps with carbonized liquid.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is as new and desired to be protected by Letters Patent is set forth in the appended claims and includes equivalents of the elements recited therein:

What is claimed is:

1. An arrangement for impregnating a mixture composed of a fluid and at least one gas comprising:

a pump having a pump housing, a pump inlet fitting disposed on the pump housing for supplying to the pump housing the mixture which is composed of a fluid under a fluid pressure and the at least one gas under a gas pressure, and a mixer connected to the pump housing via the pump inlet fitting for mixing the fluid under fluid pressure with the at least one gas under gas pressure, wherein the gas pressure depends on the fluid pressure and the the pump boosts the pressure in the mixture, which comprises the fluid impregnated with the at least one gas, inside the pump housing to a pump pressure, a pump outlet fitting disposed on the pump housing and connected with a line for discharging the impregnated fluid under pump pressure towards a tap, and a constriction through which the mixture under pump pressure travels to the tap.

2. The arrangement of claim 1, wherein the pump comprises a fitting for supplying the fluid mixed with the at least one gas and a pump outlet fitting for discharging the pressurized fluid, which includes the at least one gas, into the line.

3. The arrangement of claim 2, comprising at least one cooling system and a tap for withdrawing the cooled fluid arranged downstream of the pump outlet.

4. The arrangement of claim 1, wherein the pump with the pump inlet fitting and the pump outlet fitting are connected in a loop in which the fluid circulates.

5. The arrangement of claim 1, wherein the pump comprises a fitting for cleaning the pump, the line and the constriction.

6. The arrangement of claim 4, wherein loop comprises at least one additional pump for maintaining flow in the loop.

7. The arrangement of claim 1, wherein the mixer is filled with a bulk material for producing the mixture of the fluid and the at least one gas.

8. The arrangement of claim 1, further comprising a constant pressure regulator maintaining pressure of the fluid arranged upstream of the inlet fitting of the pump.

9. The arrangement of claim 1, further comprising a constant pressure regulator maintaining pressure of the at least one gas arranged upstream of the inlet fitting of the pump.

10. The arrangement of claim 1, further comprising a combined pressure regulator for maintaining a constant gas pressure which depends on the fluid pressure.

11. The arrangement of claim 1, wherein the pump comprises at least one bypass valve with pressure adjustment capability.

12. The arrangement of claim 1, wherein at least one bypass is provided in the pump.

* * * * *